United States Patent [19]

Stahlhammer

[11] Patent Number: 4,586,418

[45] Date of Patent: May 6, 1986

[54] ADJUSTABLE END PIN FOR THE CELLO

[76] Inventor: Mischa Stahlhammer, Heleneborgsgatan 30 A, S-117 32 Stockholm, Sweden

[21] Appl. No.: 757,188

[22] PCT Filed: May 3, 1983

[86] PCT No.: PCT/SE83/00176

§ 371 Date: Dec. 30, 1983

§ 102(e) Date: Dec. 30, 1983

[87] PCT Pub. No.: WO83/04126

PCT Pub. Date: Nov. 24, 1983

Related U.S. Application Data

[63] Continuation of Ser. No. 573,931, Dec. 30, 1983, abandoned.

[30] Foreign Application Priority Data

May 14, 1982 [SE] Sweden ..... 8203048

[51] Int. Cl.[4] ..... G10D 1/02

[52] U.S. Cl. ..... 84/280

[58] Field of Search ..... 84/280 R, 280 C

[56] References Cited

U.S. PATENT DOCUMENTS 620,393 2/1889 Whitton ..... 84/280 C 2,498,459 2/1950 Schroetter ..... 84/280 C

FOREIGN PATENT DOCUMENTS 2855854 8/1979 Fed. Rep. of Germany .... 84/280 C

*Primary Examiner*—Lawrence R. Franklin

*Attorney, Agent, or Firm*—Alfred E. Miller

[57] ABSTRACT

In a cello or similar instrument there is a fitting for an endpin. The endpin serves to give the instrument a desired position for a musician playing it. According to the invention the endpin (15) is insertable into the instrument (110) through the fitting (14), hinged in the fitting (14) and lockable in position.

5 Claims, 4 Drawing Figures

Fig. 1
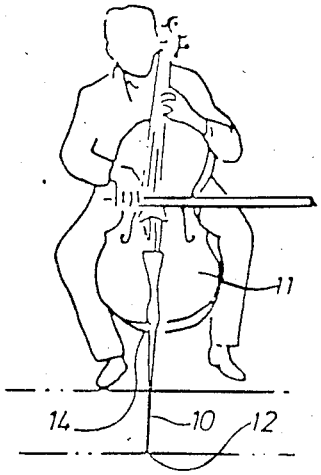
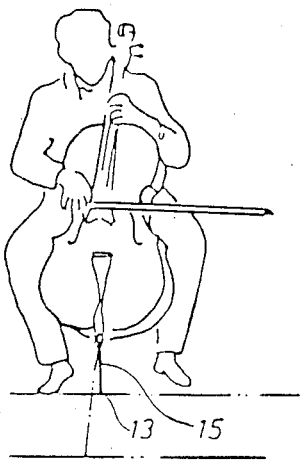
Fig. 2
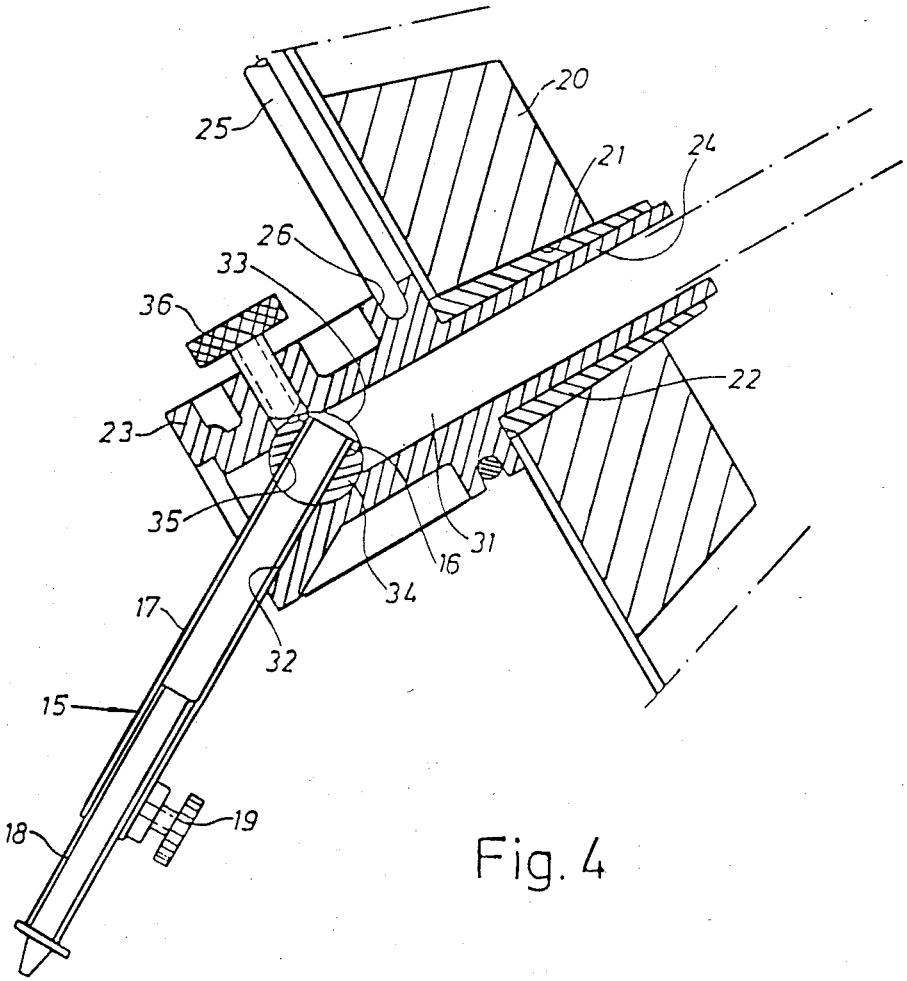
Fig. 4

ADJUSTABLE END PIN FOR THE CELLO

This application is a continuation of application Ser. No. 573,931, filed Dec. 30, 1983, now abandoned.

TECHNICAL FIELD

The present invention relates to an arrangement in a cello, or a similar instrument, having a fitting for an endpin which, when the instrument is played, remains a fixed position above the floor.

BACKGROUND ART

It is common in the art to use an endpin on a cello. The instrument itself is voluminous and requires a bulky case for storing and as protection in transport. Therefore an endpin which is permanently fixed to the instrument is not used. Such an endpin also would have the drawback that different musicians playing the same instrument at different occasions could be forced to use the instrument with the same endpin having a predetermined size and shape. Instead the endpin has been made insertable into the instrument in its longitudinal direction through a fitting in the wall of the instrument. Before playing the misicain pulls out the endpin and locks it with a set-screw in a desired position. However, it has turned out that the misicians are not in favour of having the resting point on the floor situated on a line in the longitudinal direction through the instrument. They want the resting point to be located in the vertical plane through that line but closer to the vertical line through the center of gravity. Then the instrument will rest on the musician with a certain pressure, without burdening him or her too much. Instead a curved or bent endpin is used, which can be attached to a fitting on a cello. This endpin can not be inserted into the instrument but is detachably arranged. It is troublesome to handle a separate endpin which furthermore may get lost during transport.

DISCLOSURE OF INVENTION

The present invention is intended to solve the above problem and an arrangement according to the invention for this purpose is mainly characterized therein, whereby the endpin is arranged to be insertable into the instrument through the fitting and hinged in the fitting when pulled out. In that position it is locked.

BRIEF DESCRIPTION OF DRAWINGS

In the following description the invention will be described more in detail with reference to an arrangement shown in the drawings in which:

FIG. 1 shows a musician with a cello having a prior art endpin construction.

FIG. 2 is a corresponding view of a musician with a cello having an endpin according to the invention.

FIG. 4 is a section in a larger scale through the part of the cello in FIG. 3 where the endpin of the invention is arranged.

BEST MODE OF CARRYING OUT THE INVENTION

Figure 3:
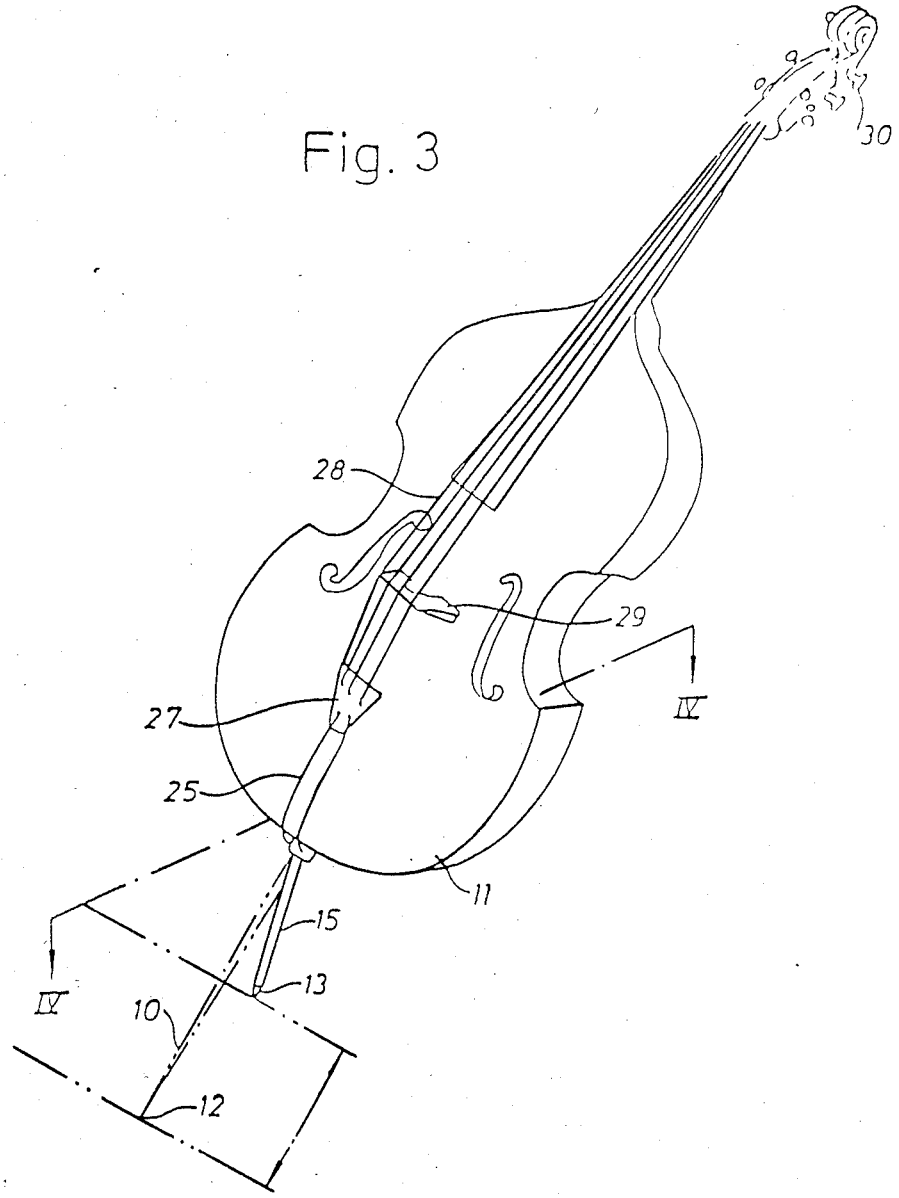
FIG. 3 is a perspective view of a cello having the new endpin, but with the prior art endpin indicated.

From the FIGS. 1, 2 and 3 it appears that the prior art shows an endpin 10, which is insertable into the instrument 11 and has a considerable length. Still it is not satisfactory, because the resting point 12 on the floor is not situated at the place where it is desired. Further it appears from the Figures that with an arrangement according to the invention it is possible in a simple way to obtain a resting point 13 on the floor closer to the instrument or better expressed closer to the vertical line through the center of gravity of the instrument when it is played.

The prior art construction of the endpin 10 is a device that is insertable in a fitting 14 and lockable in an inserted or pulled out position by a setscrew.

The inner end of the endpin 15 according to the invention has an outside abutment ring 16 (FIG. 4). The endpin 15 has two parts 17, 18, one part 18 being insertable in the other part 17 and lockable in a desired position with a setscrew 19. In the lower part of the instrument at the inner side a clamp 20 is in the form of a block of wood, in which there is a slightly conical hole 21. In the prior art construction a conical part of a fitting serving as a string holder was inserted here. Such fittings are also known having a through hole in which an endpin was inserted. According to the present invention, however a sleeve 22 being conical outside and cylindrical inside is arranged in the hole 21 in the clamp 20. The hole 21 has different diameters in different instruments.

According to the invention, when mounting an endpin, a conical sleeve 22 is inserted into the clamp 20 and a possibly projecting part is cut away. Thereafter, a fitting 23 can be arranged with its cylindrical part 24 inside the adjusted sleeve 22. Before this is done, however, the endpin 15 is inserted into the fitting from the inner side thereof but without the set-screw 19, which is mounted after the endpin has been inserted into the fitting.

When the said parts have been mounted on the instrument a tension band 25 is placed in a groove 26 around the fitting 23, up over the edge of the instrument to a string holder 27. From this holder strings 28 pass over a bridge 29 to tuning screws 30 at the head of the instrument.

In order for the fitting 23 to give the desired effect, beside the through, cylindrical hole 31, it has a recess 32 (see FIG. 4). which makes it possible to turn or articulate the endpin in about a vertical plane so that the free end 13 of the endpin can be situated behind the intersection 12 between the floor and a center line in the longitudinal direction of the instrument. In the transverse hole 33 is a cylindrical sleeve 34 which can rotate. It has a hole 35 intended for the endpin 15. The hole 35 at the inner end is widened to give room for the ring 16 on the endpin 15. With a set-screw 36 the sleeve 34 is lockable in place. The load of the instrument on the endpin is transferred to the endpin whereby the inner end of the endpin abuts the fitting inside the hole 33.

I claim:

1. An adjustable end pin arrangement for a cello having a base with an end pin receiving aperture therethrough, comprising:

a fitting adapted to be mounted in said cello aperture, said fitting having an internal, cylindrical bore, said bore having a recess at its lower end;

a sleeve mounted in said fitting, said sleeve having a bore therethrough, and said sleeve being constrained to rotational movement within said fitting, said rotational movement bringing said sleeve bore into and out of register with said fitting bore;

an end pin having an inner end, said end pin being slidably received in said fitting bore and in said sleeve bore, said end pin prohibiting rotation of said sleeve except when said inner end has been pulled out sufficiently far to lie within said sleeve bore, whereby rotation of said sleeve is permitted, said rotation moving said end pin into said recess; and means for locking said sleeve in any desired, rotated position.

2. The arrangement as claimed in claim 1 wherein said inner end includes means associated therewith for preventing removal of said end pin from said sleeve, thereby preventing removal of said end pin from said cello.

3. The arrangement as claimed in claim 1 wherein said sleeve is a cylinder mounted transverse to said fitting bore.

4. The arrangement as claimed in claim 1 wherein said end pin is constituted of two telescoping portions, and means for locking the inner telescoping portion relative to the outer one.

5. The arrangement as claimed in claim 1, wherein said end pin after being pulled out and said sleeve being rotated to a selected position has said inner end abutting said fitting thereby preventing the end pin from being pushed in, and said locking means preventing the unintentional turning of said rotatable sleeve with the end pin.

* * * * *